US009386634B2

(12) United States Patent
Lollar

(10) Patent No.: US 9,386,634 B2
(45) Date of Patent: Jul. 5, 2016

(54) ELECTRICAL RESISTANCE HEATER ASSEMBLY AND METHOD OF USE

(75) Inventor: James Patrick Lollar, Baxter, TN (US)

(73) Assignee: TUTCO, INC., Cookeville, TN (US)

( * ) Notice: Subject to any disclaimer, the term of this patent is extended or adjusted under 35 U.S.C. 154(b) by 782 days.

(21) Appl. No.: 13/087,478

(22) Filed: Apr. 15, 2011

(65) Prior Publication Data

US 2012/0263444 A1 Oct. 18, 2012

(51) Int. Cl.
*H05B 3/78* (2006.01)
*H05B 3/16* (2006.01)
*H05B 3/06* (2006.01)

(52) U.S. Cl.
CPC .. *H05B 3/16* (2013.01); *H05B 3/06* (2013.01); *H05B 2203/003* (2013.01); *H05B 2203/014* (2013.01); *H05B 2203/022* (2013.01)

(58) Field of Classification Search
CPC . H01L 21/67115; F24H 3/002; F24H 9/0063; F24H 9/02; F24H 1/101; F24H 1/142; F24H 1/103; F24H 1/201; F24H 1/202; F24H 3/02; F24H 3/022; F24H 3/0405; F24H 3/0464; F24H 3/047; F24H 3/12; F24H 9/1872; F24H 9/202
USPC ..... 392/497, 347, 370, 407; 219/155, 200, 219/267, 461, 520
See application file for complete search history.

(56) References Cited

U.S. PATENT DOCUMENTS 2,402,360 A * 6/1946 Bevins ..... 220/664
2,644,245 A * 7/1953 Hammell et al. ..... 34/547
2,737,010 A * 3/1956 Piquerez ..... 368/291
2,799,458 A * 7/1957 Nye ..... 242/118.8
2,830,384 A * 4/1958 Zehrbach ..... 34/604
2,921,172 A * 1/1960 Hackman ..... 219/532
2,978,563 A * 4/1961 Hackman ..... 392/379
3,154,281 A * 10/1964 Frank ..... 248/201
3,205,590 A * 9/1965 Deaton ..... 34/527
3,344,514 A * 10/1967 Partlow et al. ..... 29/598
3,482,617 A * 12/1969 Chamberlain et al. ..... 152/214
3,504,551 A * 4/1970 Bohenek ..... 73/431
3,790,751 A * 2/1974 Kuhn ..... 219/525
3,831,062 A * 8/1974 Haug et al. ..... 361/710
3,876,073 A * 4/1975 Herbetko ..... 242/608.7
3,880,313 A * 4/1975 Akers ..... 215/211
3,889,840 A * 6/1975 Price ..... 220/664
3,901,574 A * 8/1975 Paullus et al. ..... 439/315
3,920,887 A * 11/1975 Kloos et al. ..... 174/148
3,935,376 A * 1/1976 Cooper et al. ..... 174/138 J
3,943,333 A * 3/1976 Kokjohn et al. ..... 219/532
3,963,859 A * 6/1976 Petersen et al. ..... 174/148
3,967,094 A * 6/1976 Petersen et al. ..... 219/532
4,019,023 A * 4/1977 Marzonie et al. ..... 219/400
4,077,586 A * 3/1978 Thomas et al. ..... 242/129.5
4,151,398 A * 4/1979 Maake ..... 219/532
4,250,399 A * 2/1981 King ..... 219/532

(Continued)

*Primary Examiner* — Eric Stapleton
(74) *Attorney, Agent, or Firm* — Clark & Brody

(57) ABSTRACT

An electrical resistance heating assembly comprises a heater ribbon woven through a first mica board. The heater ribbon extends upwardly from a top surface of the first mica board to provide heat to a fluid passing over the upwardly extending heater ribbon. The heat ribbon on an underside of the first mica board is electrically isolated by a second mica board positioned adjacent the first mica board. The first and second mica boards are held together with by a clamp-containing metal place positioned adjacent the second mica board with the clamps bent over the first mica board to keep the mica boards together.

12 Claims, 12 Drawing Sheets

(56) References Cited

U.S. PATENT DOCUMENTS

| | | | | | |
|---|---|---|---|---|---|
| 4,279,355 | A | * | 7/1981 | Schwartz et al. | 220/300 |
| 4,341,946 | A | * | 7/1982 | Ohnmacht et al. | 338/293 |
| 4,448,245 | A | * | 5/1984 | de Palezieux | 165/174 |
| 4,473,170 | A | * | 9/1984 | Ciancimino | 220/300 |
| 4,531,017 | A | * | 7/1985 | Sherrill | 174/138 J |
| 4,628,189 | A | * | 12/1986 | Danko | 219/532 |
| 4,647,757 | A | * | 3/1987 | Haastrup | 392/379 |
| 4,656,340 | A | * | 4/1987 | St. Louis | 219/532 |
| 4,675,511 | A | * | 6/1987 | Sherrill | 219/532 |
| 4,700,495 | A | * | 10/1987 | Drews et al. | 34/603 |
| 4,713,527 | A | * | 12/1987 | Kicherer et al. | 219/461.1 |
| 4,794,227 | A | * | 12/1988 | Antoniazzi et al. | 219/532 |
| 4,836,580 | A | * | 6/1989 | Farrell | 285/24 |
| 4,845,345 | A | * | 7/1989 | Ohnmacht | 219/546 |
| 4,848,567 | A | * | 7/1989 | Howard et al. | 206/722 |
| 4,994,654 | A | * | 2/1991 | St. Louis | 219/532 |
| 5,131,693 | A | * | 7/1992 | Miller | 285/364 |
| 5,134,270 | A | * | 7/1992 | Bragg et al. | 219/532 |
| 5,235,906 | A | * | 8/1993 | Hsu | 99/483 |
| 5,296,685 | A | * | 3/1994 | Burstein et al. | 219/534 |
| 5,298,723 | A | * | 3/1994 | Philpot | 219/532 |
| 5,334,818 | A | * | 8/1994 | Edwards et al. | 219/539 |
| 5,437,108 | A | * | 8/1995 | Alseth | 34/196 |
| 5,497,394 | A | * | 3/1996 | Jhawar et al. | 373/130 |
| 5,578,232 | A | * | 11/1996 | Engelke | 219/532 |
| 5,601,231 | A | * | 2/1997 | Cai | 229/110 |
| 5,641,420 | A | * | 6/1997 | Peterson et al. | 219/536 |
| 5,678,760 | A | * | 10/1997 | Muso et al. | 237/2 A |
| 5,735,483 | A | * | 4/1998 | Bierlein | 242/608.7 |
| 5,791,590 | A | * | 8/1998 | Zuk et al. | 242/610.6 |
| 5,836,554 | A | * | 11/1998 | Lesage | 248/152 |
| 5,867,583 | A | * | 2/1999 | Hazelwood et al. | 381/395 |
| 5,880,366 | A | * | 3/1999 | Yamaguchi | 73/204.26 |
| 5,887,512 | A | * | 3/1999 | Kakimoto et al. | 99/348 |
| 5,916,466 | A | * | 6/1999 | Dixon | 219/536 |
| 5,935,471 | A | * | 8/1999 | St. Louis | 219/465.1 |
| 6,002,116 | A | * | 12/1999 | St. Louis | 219/542 |
| 6,041,696 | A | * | 3/2000 | Su | 99/483 |
| 6,085,442 | A | * | 7/2000 | Erickson | 34/381 |
| 6,088,928 | A | * | 7/2000 | Sugimoto | 34/144 |
| 6,108,940 | A | * | 8/2000 | St. Louis | 34/601 |
| 6,222,133 | B1 | * | 4/2001 | St. Louis | 174/138 J |
| 6,259,070 | B1 | * | 7/2001 | Audet | 219/461.1 |
| 6,276,832 | B1 | * | 8/2001 | Wade, III | 384/204 |
| 6,345,719 | B1 | * | 2/2002 | Jaycox | 206/570 |
| 6,509,554 | B2 | * | 1/2003 | Howard et al. | 219/536 |
| 6,575,398 | B2 | * | 6/2003 | Nakamura et al. | 242/608.7 |
| 6,596,974 | B2 | * | 7/2003 | Howard et al. | 219/536 |
| 6,770,855 | B2 | * | 8/2004 | Howard et al. | 219/536 |
| 7,007,404 | B2 | * | 3/2006 | Gagnon | 34/132 |
| 7,017,953 | B2 | * | 3/2006 | Benscoter et al. | 285/401 |
| 7,047,663 | B2 | * | 5/2006 | Zhang et al. | 34/348 |
| 7,157,818 | B2 | * | 1/2007 | Jones | 310/63 |
| 7,220,365 | B2 | * | 5/2007 | Qu et al. | 252/70 |
| 7,566,079 | B1 | * | 7/2009 | Callahan et al. | 285/362 |
| 7,829,826 | B2 | * | 11/2010 | Arens et al. | 219/536 |
| 7,988,544 | B2 | * | 8/2011 | Vanden Bosch et al. | 454/367 |
| 2002/0125243 | A1 | * | 9/2002 | Lange et al. | 219/536 |
| 2003/0029855 | A1 | * | 2/2003 | Haluschka et al. | 219/270 |
| 2003/0116558 | A1 | * | 6/2003 | Lipp et al. | 219/493 |
| 2003/0184091 | A1 | * | 10/2003 | Ricard | 285/358 |
| 2005/0005548 | A1 | * | 1/2005 | Charron | 52/302.1 |
| 2005/0121912 | A1 | * | 6/2005 | Benscoter et al. | 285/401 |
| 2006/0191947 | A1 | * | 8/2006 | Jedryk et al. | 220/788 |
| 2006/0220352 | A1 | * | 10/2006 | Clarke et al. | 280/728.2 |
| 2006/0225389 | A1 | * | 10/2006 | Scott et al. | 55/498 |
| 2006/0235393 | A1 | * | 10/2006 | Bono et al. | 606/61 |
| 2006/0249520 | A1 | * | 11/2006 | DeMonte | 220/737 |
| 2007/0120362 | A1 | * | 5/2007 | Poder | 285/314 |
| 2007/0278211 | A1 | * | 12/2007 | Arens et al. | 219/536 |
| 2009/0020520 | A1 | * | 1/2009 | Forget | 219/461.1 |
| 2010/0282735 | A1 | * | 11/2010 | Fattorel et al. | 219/520 |
| 2012/0325800 | A1 | * | 12/2012 | Kutz | 219/481 |

* cited by examiner

ELECTRICAL RESISTANCE HEATER ASSEMBLY AND METHOD OF USE

FIELD OF THE INVENTION

The present invention relates to an improved electrical resistance heater assembly and method of use.

BACKGROUND ART

The use of electrical resistance heaters to heat air or other fluids is well known in the prior art. For clothes dryers, it is common to use a ribbon or helical coils to heat the air prior to its entry into the dryer drum. FIGS. 1 and 2 show a prior art heater assembly designated by the reference numeral 100 that is typically used in a clothes dryer application. The heater assembly typically sits in a well in the heater and air is drawn over the heater ribbon and into the clothes drying drum.

The heater assembly 100 is usually made with two pieces of mica board 101 and 103 that provide electrical isolation of the heater ribbon 105. The heater ribbon is woven through openings 107 in mica board 101 with the other mica board 103 placed adjacent to mica board 101 to sandwich the segments of the heater ribbon passing between the openings 107 and underneath the top mica board. The mica boards are held together with eyelets 109. Other fasteners such as pop rivets, screws and the like have also been used. One end 111 of the assembly includes a terminal assembly 113 for supplying power to the heater ribbon.

These prior art heater assemblies have some problems in that they are large in size and are somewhat flimsy due to their free ends. As such, a need exists to provide improved heater assemblies for these types of applications as well as other heating applications. The present invention responds to this need by providing an improved heater assembly.

SUMMARY OF THE INVENTION

A first object of the invention is an improved heater assembly.

A second object of the invention is an improved method for heating a fluid, particularly, air for a clothes dryer application.

Other objects and advantages will become apparent as a description proceeds.

In satisfaction of the objects of the invention, an improved electric resistance heater assembly is provided. The heater assembly comprises first and second insulators, which are annular or circular in shape. These insulators can be any type of insulating materials, with mica boards being a preferred type of insulators. The first insulator has a plurality of spaced apart openings that are designed to receive one or more heater elements, for example, heater ribbons. The ribbons are woven through the plurality of openings so that first portions of the heater ribbon extends upwardly from a top surface of the first insulator and second portions of the heater ribbon run along a bottom surface of the first insulator. In a preferred embodiment, two rows of heater ribbons are provided in the heater assembly.

The second insulator has a top surface that is positioned adjacent the bottom surface of the first insulator to electrically isolate the second portions of the heater ribbon.

A plate is positioned adjacent a bottom surface of the second insulator. The plate includes a plurality of tabs extending from inner and outer peripheral edges of the plate. The tabs are sized to be bent over the first and second insulators to keep the first and second insulators together. The tabs are spaced apart from each other along each edge of the metal plate. The tabs on the inner and outer edges can be in an opposing relationship so that the inner tab faces the outer tab or a staggered relationship so that the tab of one edge is positioned between tabs running along the other edge.

The heater assembly also includes means for mounting the plate to a structure to support the heater assembly in a desired location or place.

The first and second insulators can have notches in the outer and inner peripheral edges thereof, with each notch aligned with each tab of the plate and sized to receive the tab when bent over to keep the insulators together.

The means for mounting the plate can comprise a plurality of members spaced along either edge of the plate. In one embodiment, each of the members can extend upwardly from an edge of plate and terminate with a throughhole-containing flange for mounting purposes. The insulators can also be notched to receive the members of the mounting means. The notches, either for the tabs, the mounting members or both perform an anti-rotation role with respect to the plate and the insulators.

While the first and second insulators can be made in one piece, the insulators can be made in segments. For example, first and second insulators are made in segments. When the insulators are made in segments, it is preferred that the joints formed by the segments are arranged to coincide with the tabs of the plate so that the free ends of the segments are held together by the tabs. Preferably, the joints formed by the segments of each of the first and second insulators are arranged so that the joints of one insulator are not aligned with the joints of the other insulator. The joints can be displaced from each other in an angular manner, e.g., 45 degrees, 90 degrees and the like.

The heater assembly can also include a terminal assembly, wherein the ends of the heater ribbon are terminated so that they can be connected to a source of power. The plate can include a supporting structure to support the terminal block that holds the terminals for the heater ribbon.

The invention also includes a method of using the inventive heater assembly in applications where a fluid needs to be heated. In particular, the heater assembly is especially adapted for use as a heater in a clothes dryer.

DETAILED DESCRIPTION OF THE DRAWINGS

DESCRIPTION OF THE PREFERRED EMBODIMENTS

Figure 1:
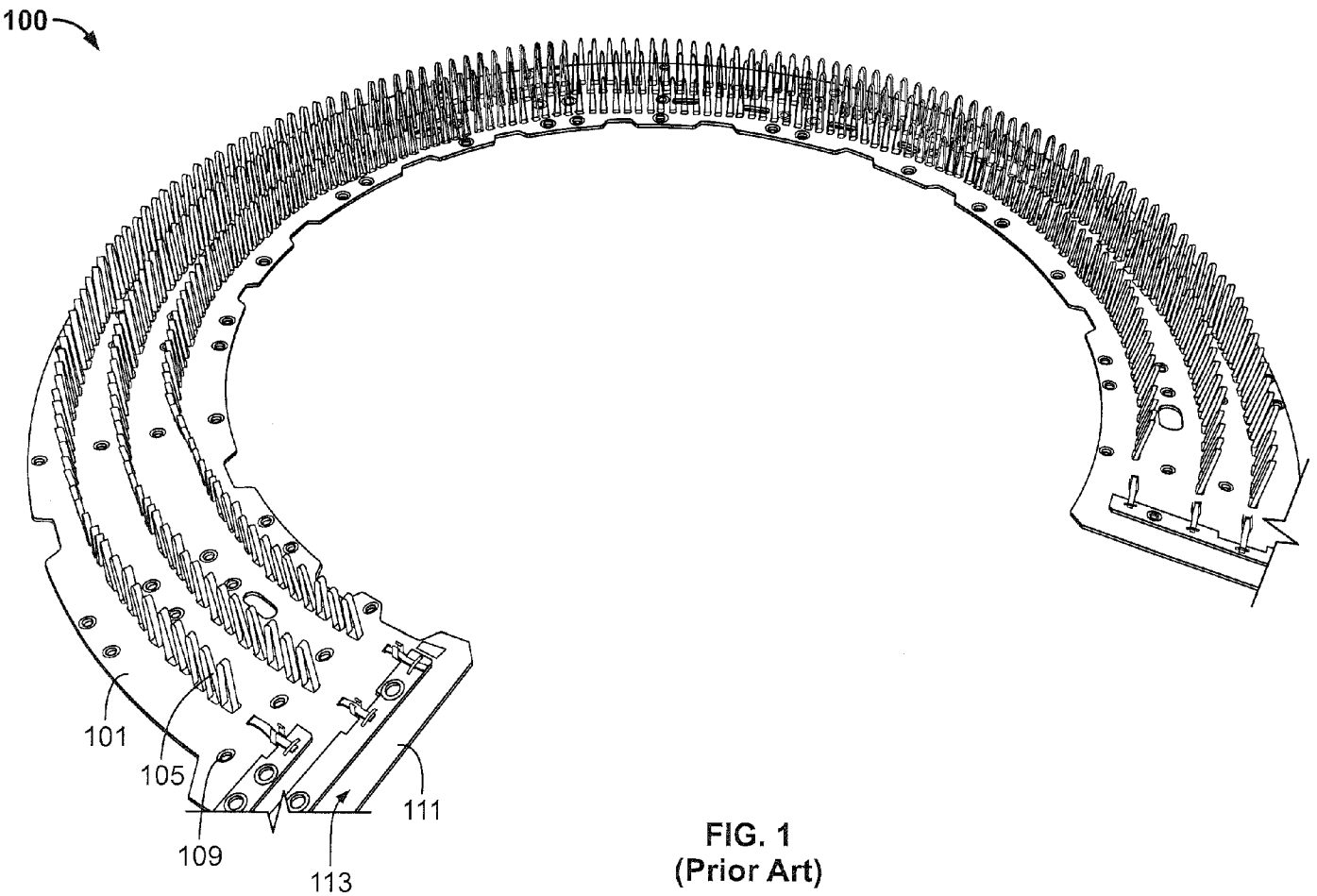
FIG. 1 (Prior Art)
FIG. 1 is a perspective view of a prior art heating assembly for a clothes dryer.
Figure 2:
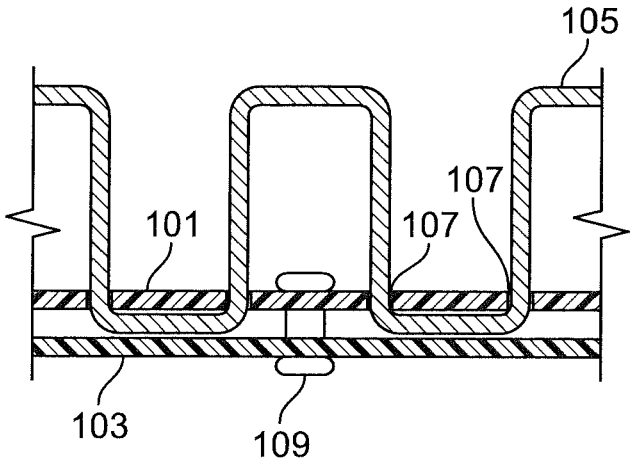
FIG. 2 (Prior Art)
FIG. 2 is a cross sectional view of a portion of the heater assembly of FIG. 1.

A first embodiment of the invention is illustrated in FIGS. 3-8. The inventive ribbon heater is designated by the reference numeral 10 and includes a pair of heater ribbons 1, and pair of insulators 3 and 5 and a metal connecting plate 7. The heater assembly is preferably circular or annular in shape.

The insulators 3 and 5 can be made out of any electrically insulating material, with a preferred material being mica, which is known for its insulating qualities.

Figure 5:
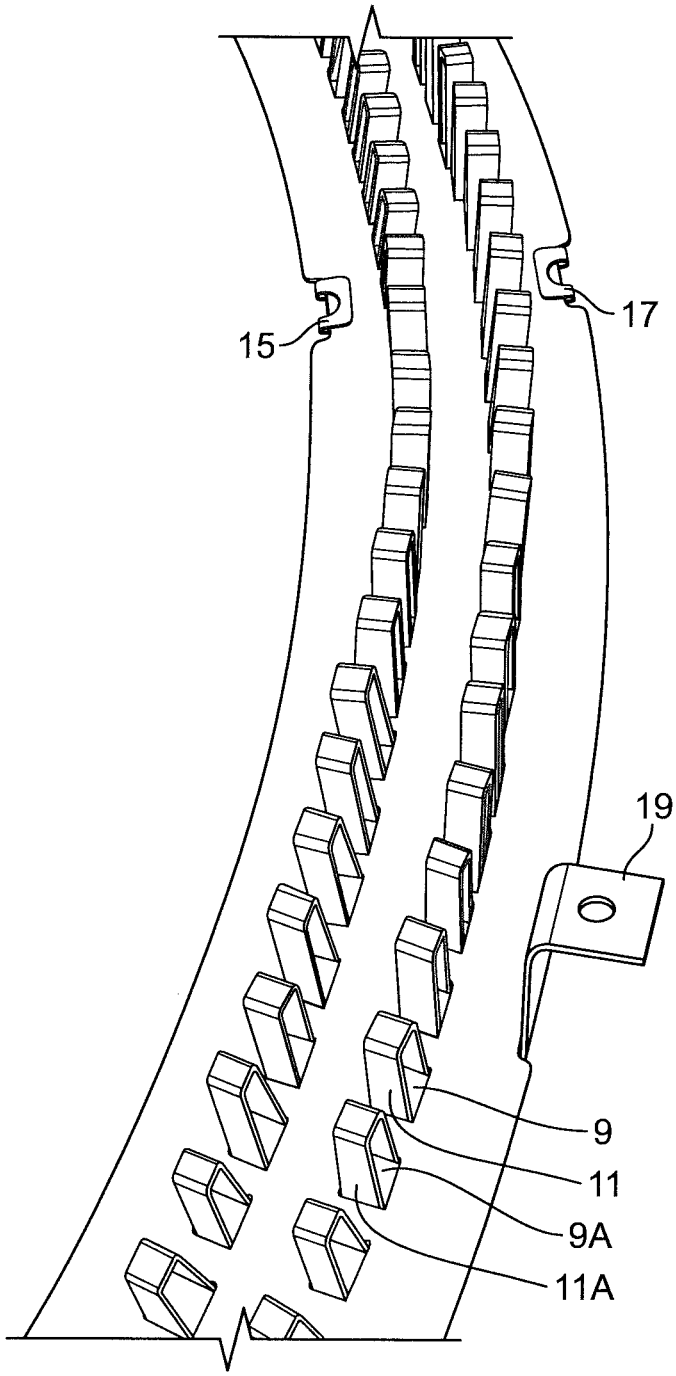
FIG. 5 is an enlarged view of a portion of the heater assembly of FIG. 3.

The heater ribbon 1 is woven through openings 9 in the top insulator 3, see FIG. 5, such that the ribbon forms an upstanding portion 11 for fluid such as air to travel over for heating purposes. Each ribbon 1 travels through the opening 9, with a second portion of the ribbon extending under the bottom surface 13 of the insulator 3, see FIG. 6. The ribbon 1 then passes upwardly through an adjacent opening 9A to form an adjacent upstanding portion 11A, see FIG. 5. Since these types of heater ribbons are known, a further description is not deemed necessary for understanding of the invention. While a heater ribbon is depicted, any heater element with a different resistance wire configurations could be employed as part of the inventive heater assembly.

The second insulator 5 is positioned beneath the first insulator 3 to electrically isolate the heater ribbon running through the openings 9 and along an underside 13 of the first insulator 3.

Figure 4:
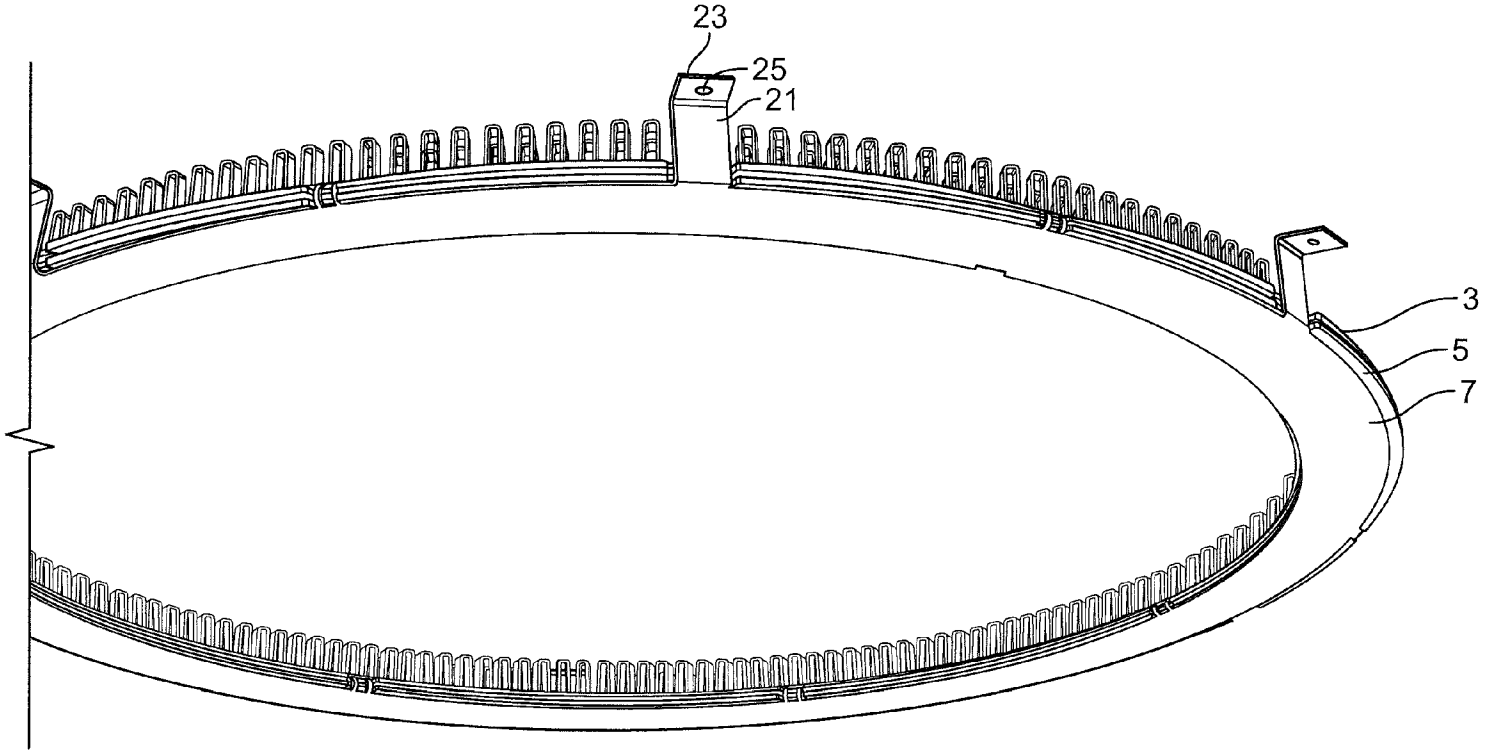
FIG. 4 is a bottom perspective view of the embodiment of FIG. 3.
Figure 6:
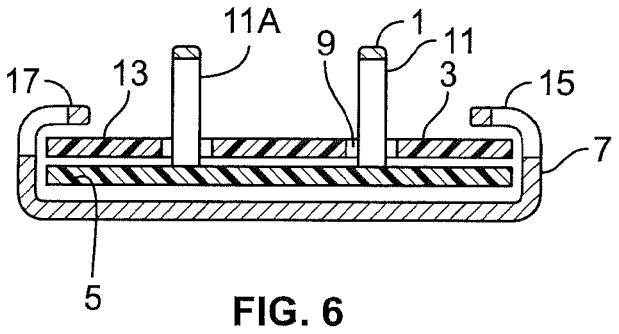
FIG. 6 is a cross sectional view along the line 6-6 of FIG. 3.

The first and second insulators 3 and 5 are maintained together by the metal connecting plate 7, see FIG. 4. The plate 7 has a plurality of inner tabs 15 that are spaced apart along an inner periphery of the plate and a plurality of spaced apart outer tabs 17 that are spaced apart along an outer periphery of the plate 7, see FIG. 5. As shown in FIG. 6, the tabs 15 and 17 are bent to keep the insulators together so that the heater ribbon is electrically isolated.

The tabs can have any shape providing that they are sufficient in dimension to extend from the plate 7 and around the edges of the insulators 3 and 5, and to contact or extend over a portion of the top of the insulator 3 to keep the insulators together. The tabs can be solid or have an opening 16 therein, with the opening providing weight savings and facilitating the bending of the tabs.

Figure 3:
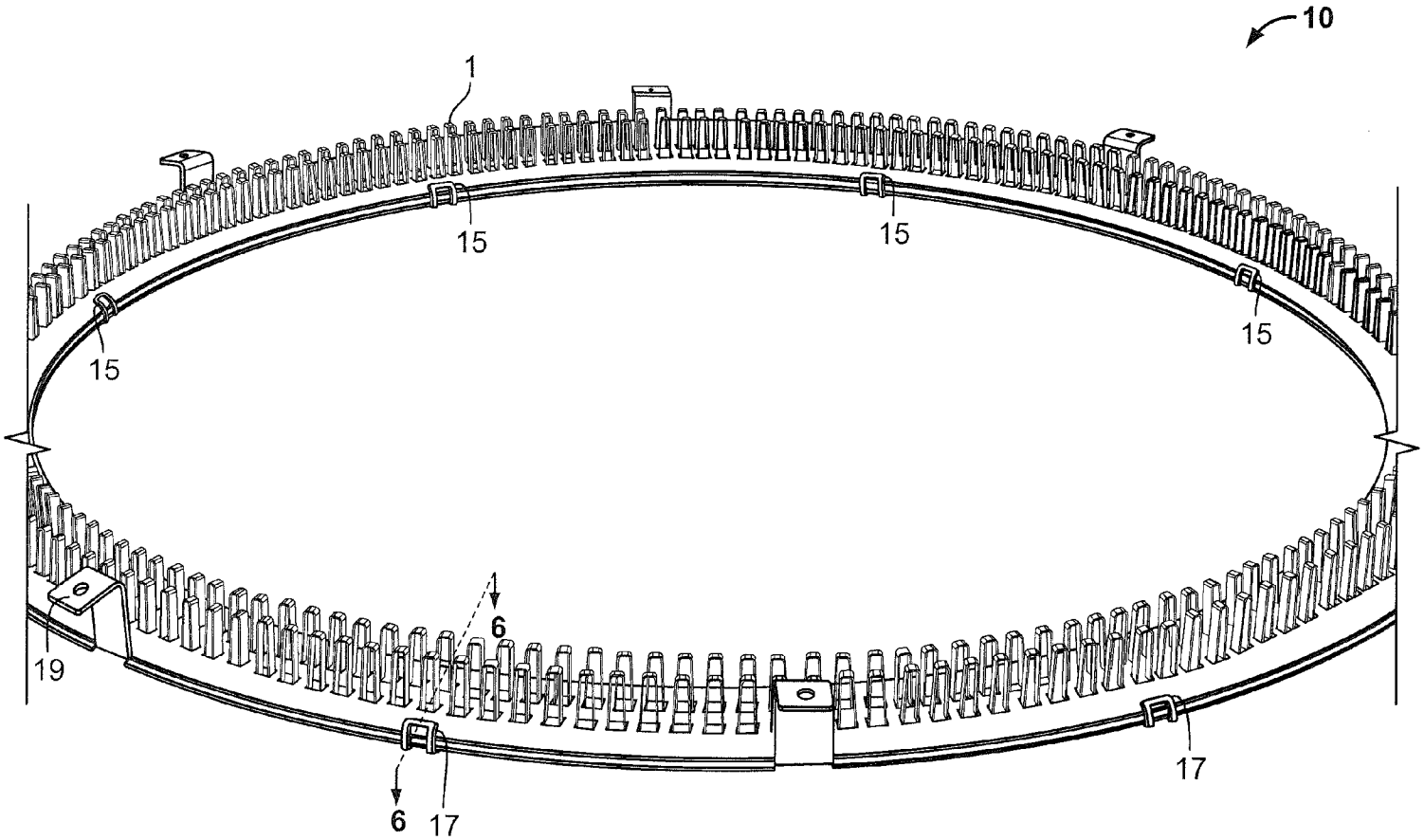
FIG. 3 is a top perspective view of one embodiment of the heater assembly of the invention.

The tabs 15 and 17 are shown arranged so as to be in an opposing relationship as shown in FIG. 5. However, the tabs 15 and 17 could be arranged so that they are not in an opposing relationship if so desired. When the insulators are made in segments as described below, it is preferred that the tabs 15 and 17 should be in an opposing relationship at joints of the segments. A number of tabs 15 and 17 can be used as long as the number is sufficient to keep the insulators 3 and 5 in an attached together configuration. In the embodiment of FIG. 3, 8 sets of tabs 15 and 17 are used, but more or less than this number can be employed.

The plate 7 also has a number of spaced apart mounting flanges 19, see FIGS. 4 and 5. Each flange has a member 21 that extends from the plate body and terminates in a flange 23 with an opening 25 therein. The flanges 19 are used as a means for mounting the heater assembly to a structure when used in a heating application. It should be understood that the flanges 19 are one example of a means for mounting the heater assembly in a location for use but other mounting configurations could be used. For example, the tab 23 could be removed and an opening could be located in the member 21 for mounting purposes. The members 21 could extend from the plate 7 on the same plane that coincides with a plane of the plate itself for mounting instead of being perpendicular to the plate 7.

Figure 7:
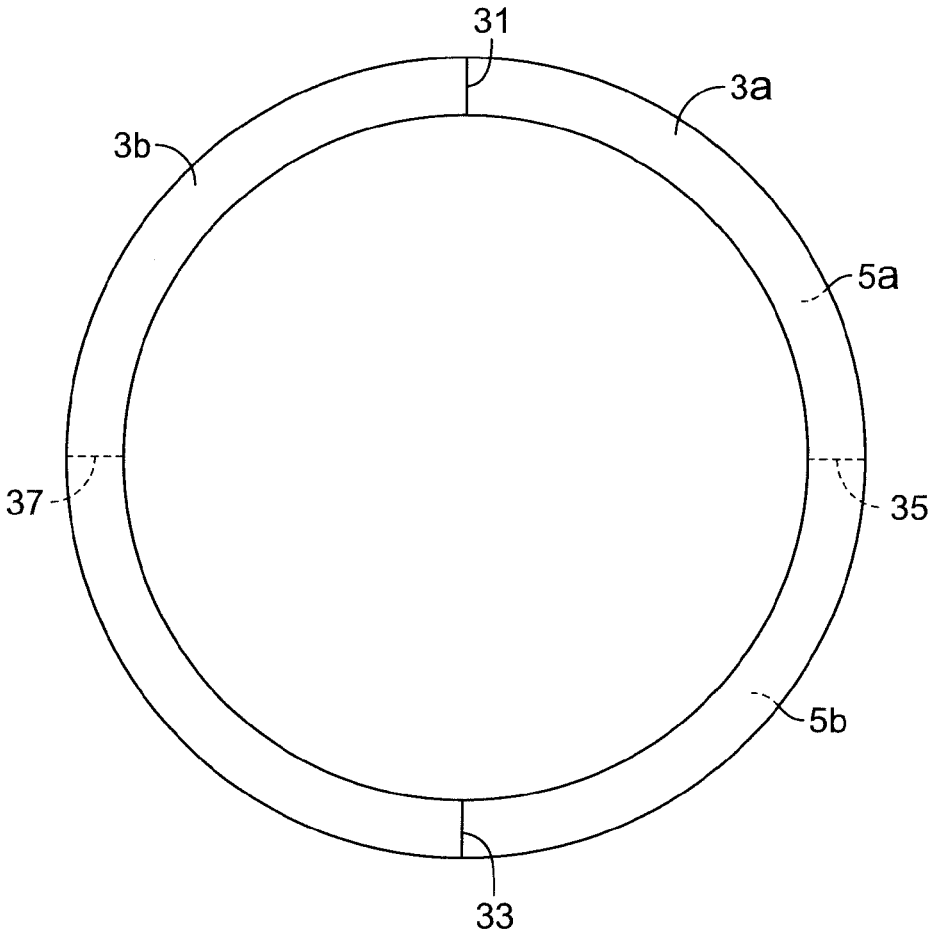
FIG. 7 is a schematic view of the insulators in segments and their abutting ends.

While the insulators 3 and 5 could be made in one piece, it is preferred that each of the insulators is made in two or more segments. FIG. 7 shows a schematic view of a pair of insulators 3 and 5 (without openings 9) to show an exemplary segment configuration. The top insulator 3 could be made in two segments 3*a* and 3*b*, each essentially forming a 180 degree segment, with ends of each segment butting together at joints 31 and 33.

The insulator 5 is also made in two segments 5*a* and 5*b*. However, the segments 5*a* and 5*b* are rotated about a center of the heater assembly so that joints 35 and 37 of the insulators 5*a* and 5*b* are not aligned with the joints 31 and 33 of the insulators 3*a* and 3*b*. The rotation is shown in FIG. 7 as a 90 degree rotation but other rotations could be used, e.g. 45 degrees, etc.

Figure 8:
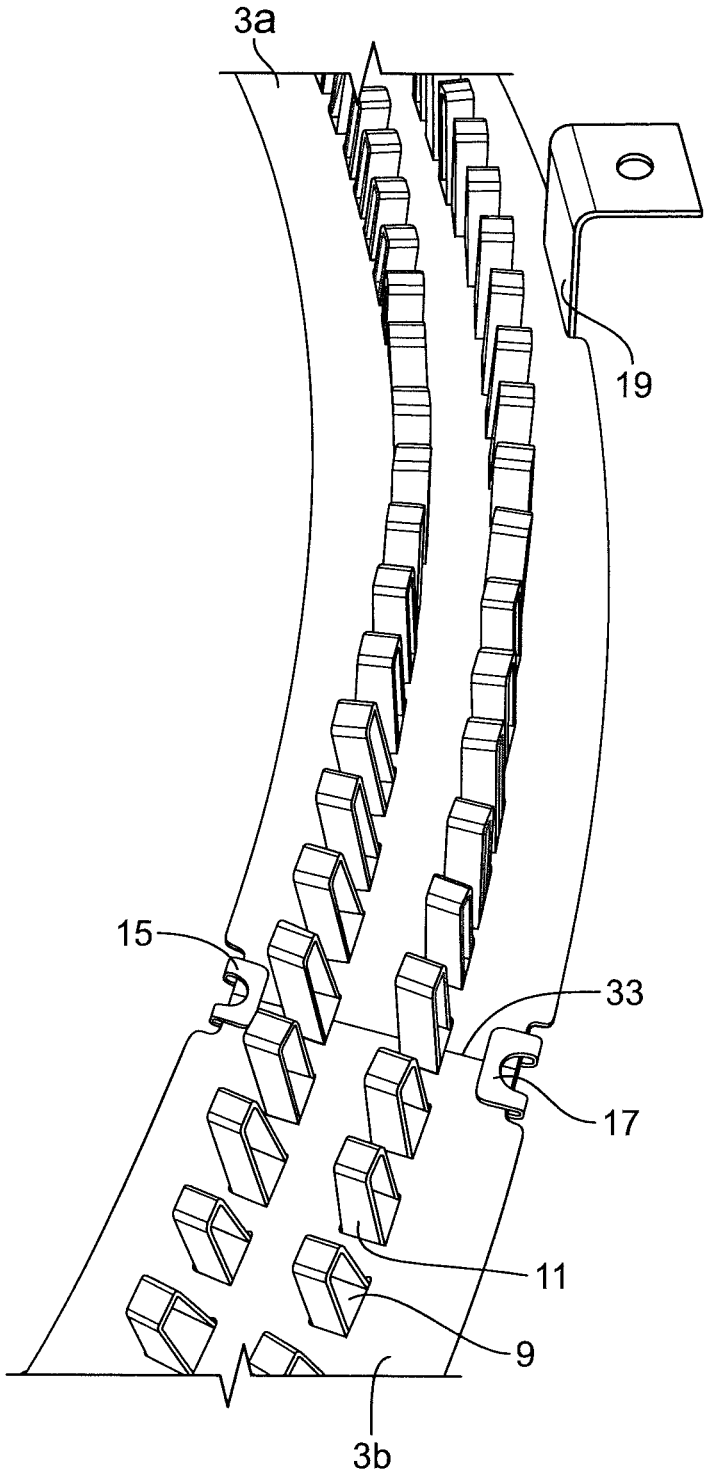
FIG. 8 shows an enlarged view of the segments of the top insulator of the heater assembly of FIG. 3 aligned with tabs of the metal connecting plate.

When joints of the insulator segments are present, at least some of the tabs 15 and 17 of the plate 7 should be aligned with the joints to ensure that ends of each of the segments forming the joints are held together. FIG. 8 shows the joint 33 of the top insulators 3*a* and 3*b* and how the tabs 15 and 17 are aligned with the joint 33 to keep the insulators 3*a* and 3*b* attached to the bottom insulator 5*b*. As shown in FIGS. 3 and 4, additional tabs 15 and 17 other than those provided at the joints can be used to keep the insulators 3 and 5.

Figure 9:
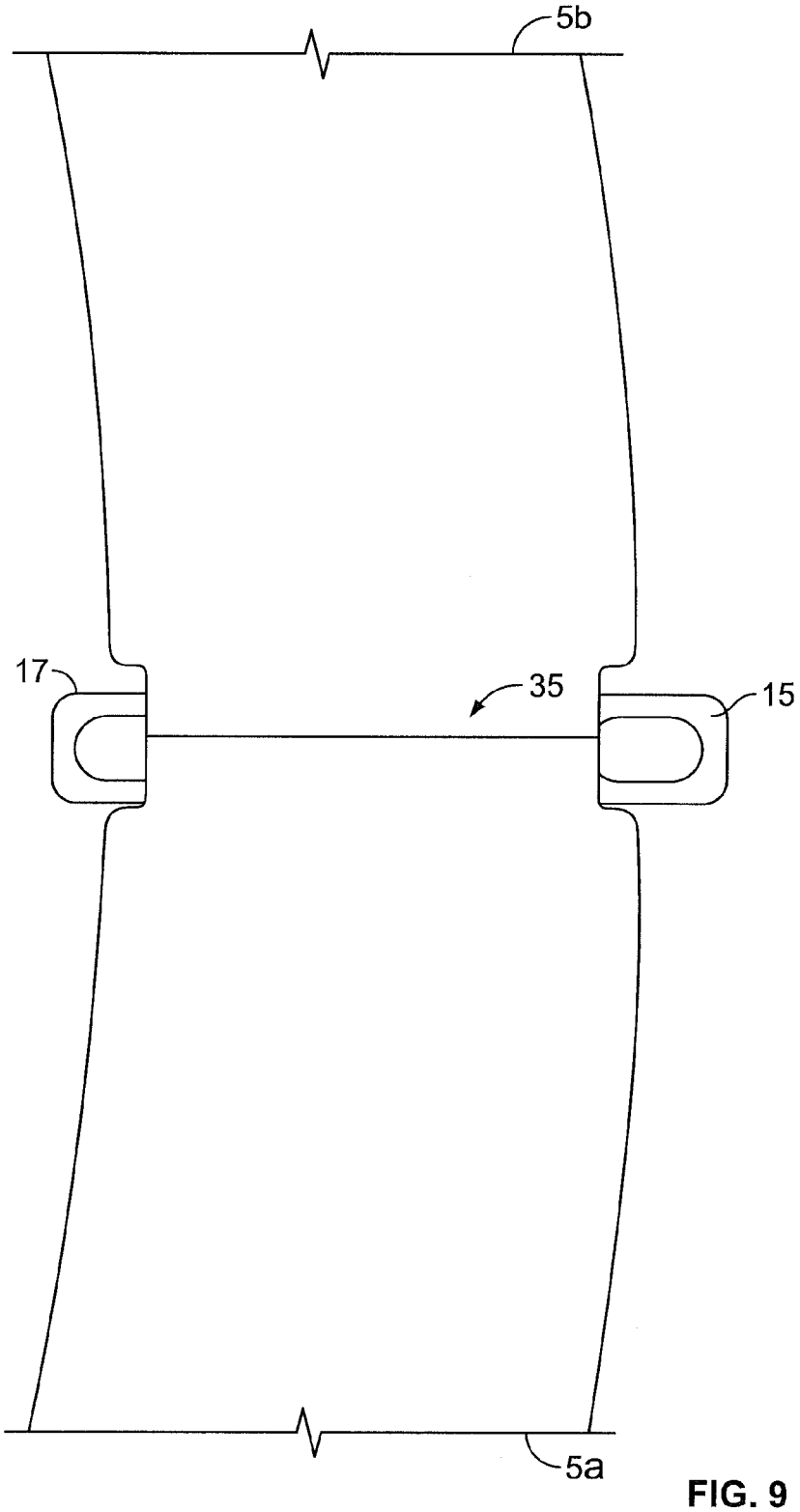
FIG. 9 shows a joint of the bottom insulator with the metal connecting plate before the plate tabs are bent.

FIG. 9 shows the joint 35 of the bottom insulators 5*a* and 5*b* before the tabs 15 and 17 are bent and before the top insulator segment 3*a* is placed over the joint 35.

Figure 10:
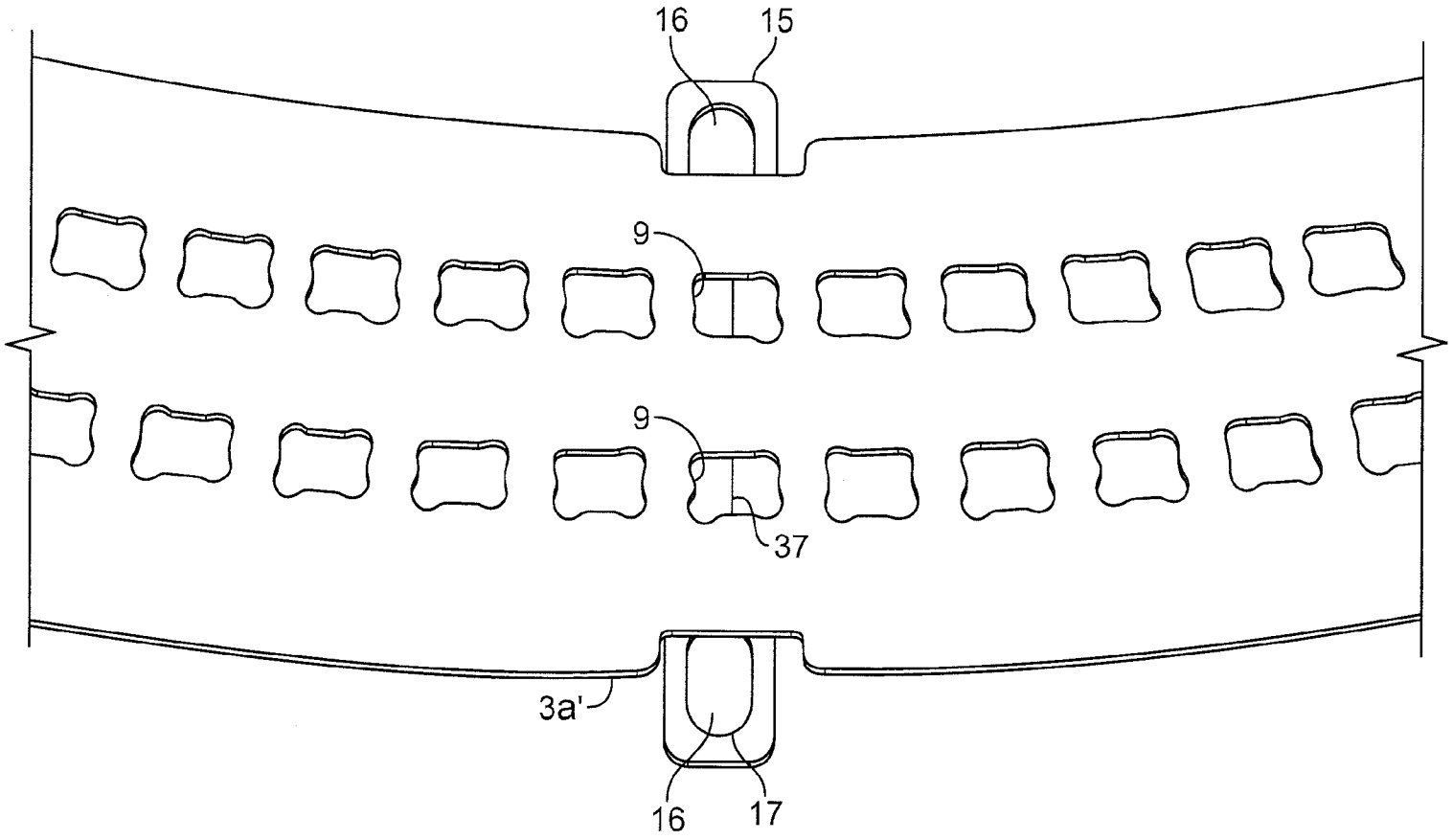
FIG. 10 shows the top insulator on the bottom insulator metal plate combination of FIG. 9.

FIG. 10 shows the top insulator 3*a* with openings 9 placed over the bottom insulator segments 5*a* and 5*b* with the tabs 15 and 17 in an unbent state. The joint 37 can be seen through the openings 9. The heater ribbon 1 when threaded through the openings 9 in the top insulator 3*a* that are aligned with the joint 37 are in proximity to the metal plate 7 and are not totally electrically isolated therefrom. As a result, there is a chance that a short circuit could occur between the heater ribbon 1 and the metal plate 7 through the joint 37.

Figure 11:
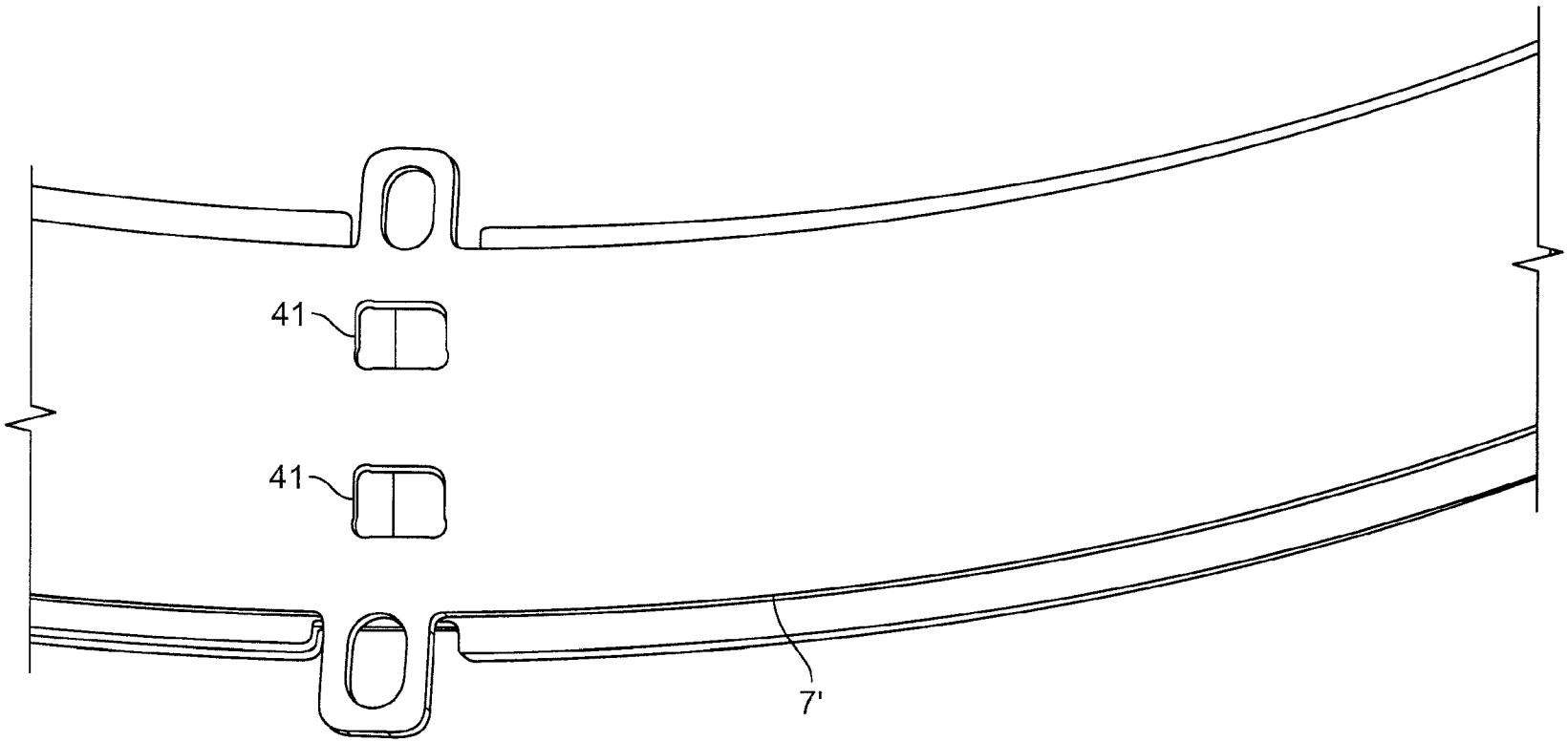
FIG. 11 shows the metal plate of the embodiment of FIG. 8-10.

FIG. 11 shows a modified plate 7' wherein the plate has openings 41 so that there is no metal in the area where the openings 9 in FIG. 10 align with the joint 37. By creating the openings 41 in the plate 7, an electrical clearance is created that minimizes the possibility of a short circuit between the heater ribbon and plate 7 via the space created by the joint 37.

Referring back to FIG. 5, each of the insulators 3 and 5 includes notches positioned along the inner and outer periphery of the insulators. The notches are positioned and sized to receive the tabs 15 and 17 when bent to keep the insulators 3 and 5 together.

The insulators 3 and 5 can also include a number of second notches 45. The notches 45 are positioned and sized to receive the members 21 of the flanges 19.

The presence of the notches is beneficial since they provide an anti rotation feature for the insulators 3 and 5. Unlike the prior art heater assemblies that use fasteners that extend through both of the insulators, the inventive heater assembly relies on the clamping force created by bending of the tabs 15 and 17 over and/or onto the top surface of the top insulator 3. The notches 43 and/or 45 prevent the rotation of the insulators with respect to each other and the plate 7. The notches 45 are also beneficial during assembly of the heater. This is because the flanges 19 can rest in the notches 45 of the bottom insulator 5 and hold it in place before the top insulator is put in place. The notches 45 of both the top and bottom insulators then hold the two insulators 3 and 5 in place until the tabs 15 and 17 of the plate are bent to keep the insulators together.

In assembly, the bottom insulator 5 is positioned adjacent the plate 7. Then, the top insulator with the heater ribbon 1 woven therein is placed over the bottom insulator 5. If notches 43 and 45 are present, the insulators are arranged so that the flanges 19 are positioned in the slots 45 and the tabs 15 and 17 are aligned with the notches 43. Once the insulators 3 and 5 are in place, the tabs 15 and 17 are bent over so that a portion of the each tab is positioned over the top of the insulator 3. The degree of bending can be such that the insulator 3 is clamped down onto the insulator 5. Alternatively, the bending can be such that the insulators 3 and 5 are still positioned adjacent each other but in a looser arrangement to accommodate thermal expansion.

Figure 12:
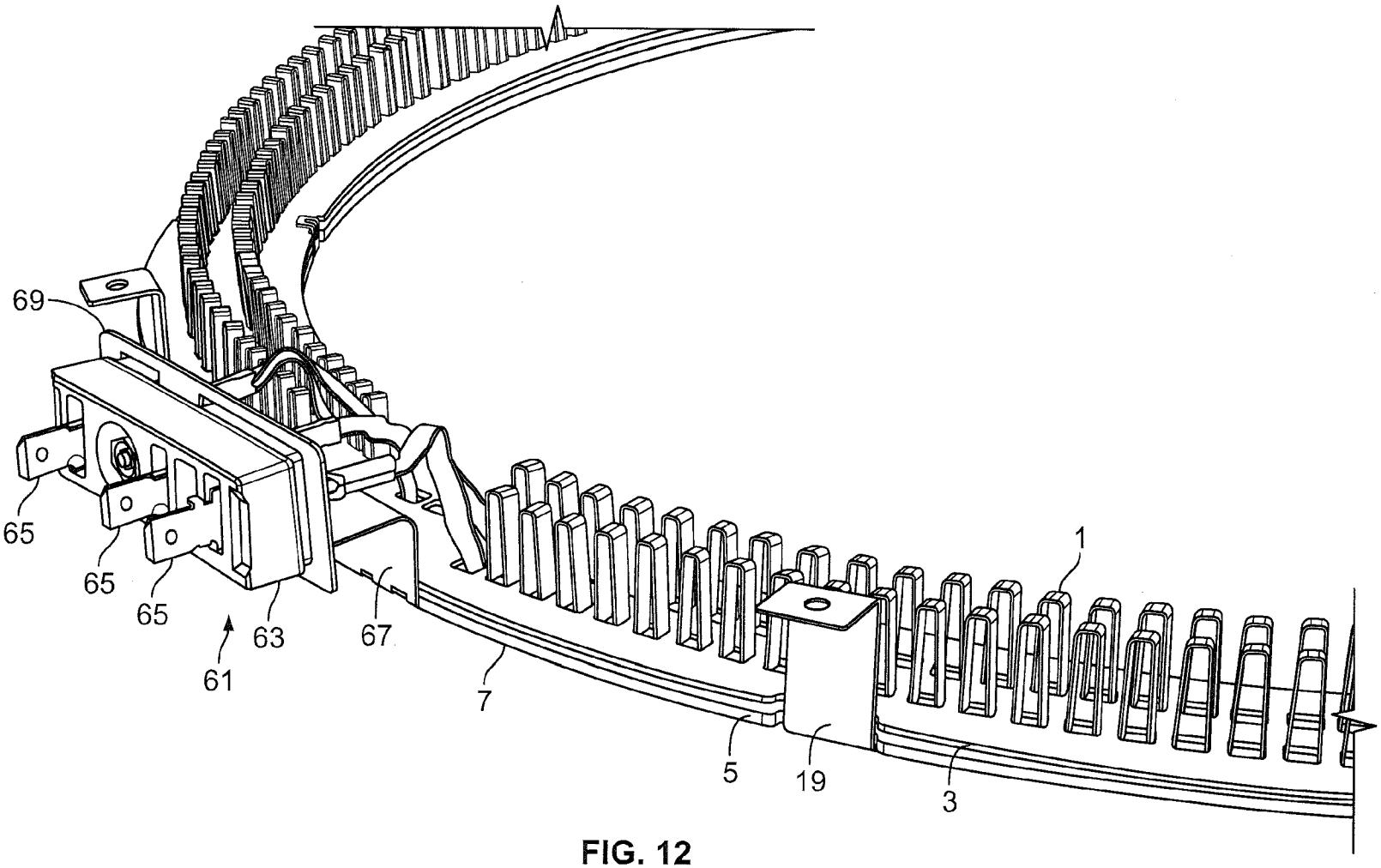
FIG. 12 shows a perspective view of the terminal assembly of the embodiment of FIG. 3.

FIG. 12 shows one example of a terminal assembly of the inventive heater assembly. The terminal assembly is designated by the reference numeral 61 and includes a terminal block 63 and terminals 65 that are attached to ends of the heater ribbon for power supply. The terminal assembly is conventional and a further description is not deemed necessary for understanding of the invention. The terminal block 63 is supported using the metal plate 7. A support flange 67 extends upwardly and outwardly from the edge of the metal plate. The flange 67 includes a plate 69, which supports the terminal block. It should be understood that the flange 67 is just an example of a means for supporting the terminal assembly on the heater assembly 10. Other configurations or shapes that extend from the metal plate can be used.

Figure 13:
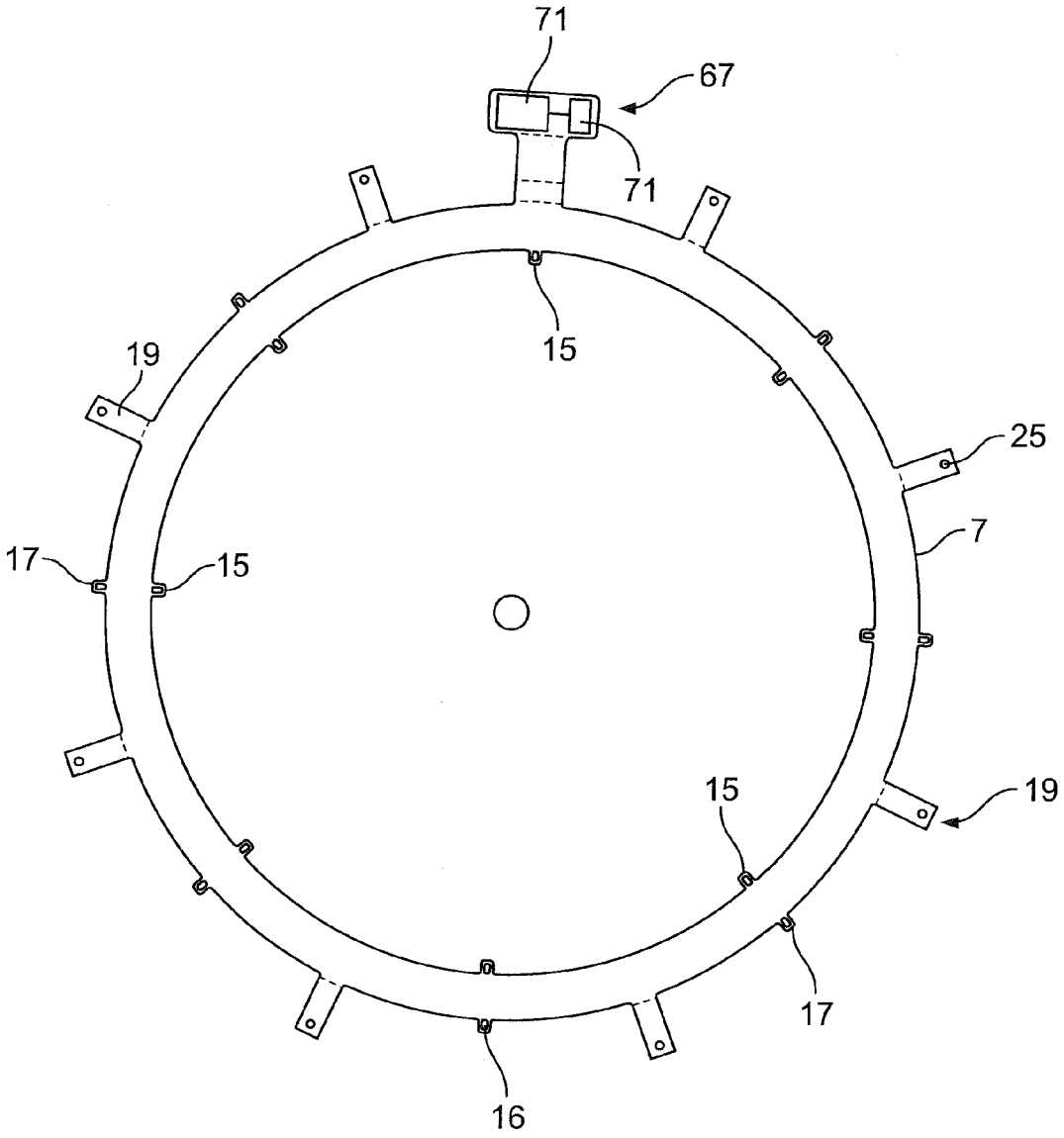
FIG. 13 shows a top view of the plate of the heater assembly of FIG. 3.

FIG. 13 shows the plate 7 in more detail. The tabs 15 and 17 as well as the flange 19 are shown in unbent configurations. The support flange 67, which is also shown unbent, is also depicted in more detail to retain the terminal block of the terminal assembly. The support flange includes a pair of openings 71 to receive the terminal blocks.

The plate is shown with seven (7) sets of opposing tabs 15 and 17 as well as eight (8) flanges 19. One tab 15 is positioned opposite the terminal assembly support flange 65. As mentioned above, different numbers of tab sets and flanges could be used and the tabs 15 and 17 could be offset from each other if so desired. While the plate is shown with a solid construction, it could contain openings for weight savings, as long as the openings were not too many in number to compromise the ability of the plate to keep the insulators together. The plate can be made out of any material, with a preferred material being an aluminized steel, which is a common material for heater support elements.

The heater assembly can be used in any application that requires the heating of a fluid that would be passed over the upstanding portions of the heater ribbon. A preferred application is that of a clothes dryer. This is because the present invention provides significant advantages over the types of heaters normally used in clothes dryer applications.

It should also be understood that reference to the top and bottom insulators is a relative one based on the orientation of the heater assembly when installed in a desired location. For an installation wherein the heater assembly is generally horizontal with the heater ribbon portions 11 protruding upwardly, the insulator 3 would be considered to be on the top. However, the heater assembly could also be installed with the plate 7 being on the top and the protruding portions extending downwardly such that the insulator 3 would be a bottom insulator with respect to the insulator 5. The heater assembly could also be installed such that the insulators and plate are vertically aligned, in which case, the insulators would be in a side by side relationship but not necessarily top and bottom. Nevertheless, the use of top and bottom surfaces in connection with the insulators and plate is done to distinguish the relative positions of the surfaces of the insulators and plate and not to be representative of any particular orientation of the heater assembly in use.

One advantage is that the traditional fasteners, e.g., eyelets, commonly used in the prior art heat assembly can be eliminated. With the elimination of traditional fasteners, the isolative support structure, i.e., the insulators, can be narrower in width without sacrificing electrical clearances. In the prior art heaters, since the eyelets are installed between the ribbons, a sufficient amount of distance is required between the ribbons, which makes the insulator width greater. By not requiring that a fastener be used and removing the need for a clearance to allow the tool to gain access between the ribbons, the insulator width can be made smaller and the overall size of the heater assembly is reduced.

The access of a fastening tool can also compromise the integrity of the element and/or damage the design shape. Thus, the fact that the fastening tool is not necessary offers a further advantage in this regard.

Again, the elimination of traditional fasteners has additionally allowed the assembly to be constructed with minimal electrical clearances. The fact that traditional fasteners and accompanied fastener tooling are not required, allows the design to be constructed in extremely close quarters and still maintain minimal electrical clearances.

Anti-rotational notching in the insulators prevents bi-directional rotation movement both during assembly and operation. This method does not depend upon any additional components to provide this anti-rotational feature.

Since the heater assembly can be made circular in shape, a more rigid assembly that provides for stand alone mounting can be provided. This type assembly does not depend upon additional components for mounting or rigidity.

The electrical termination is not held as rigidly as prior art, which solves early failure problems by accommodating thermal expansion and contraction during high temperature stress/life testing.

Because of the compact design of the heater assembly, the height of the upstanding portions of heater ribbon can be made smaller as compared to the prior art heaters. This smaller dimension is advantageous in that the upstanding portion has less of a tendency to migrate or move during operation, thus leading to a more stable operation.

As such, an invention has been disclosed in terms of preferred embodiments thereof which fulfills each and every one of the objects of the present invention as set forth above and provides a new and improved electrical resistance heating assembly and method of use.

Of course, various changes, modifications and alterations from the teachings of the present invention may be contemplated by those skilled in the art without departing from the intended spirit and scope thereof. It is intended that the present invention only be limited by the terms of the appended claims.

I claim:

1. An electric resistance heater assembly comprising:

a) a first insulator having a plurality of spaced apart openings therein and having an annular shape;

b) at least one heater element woven through the plurality of openings so that first portions of the heater element extends upwardly from a top surface of the first insulator and second portions of the heater element run along a bottom surface of the first insulator;

c) a second insulator being generally annular in shape, a top surface thereof positioned adjacent to the bottom surface of the first insulator to electrically isolate the second portions of the heater element;

d) a plate positioned adjacent a bottom surface of the second insulator, the plate having an annular shape with inner and outer peripheral edges, the plate further including a plurality of tabs, each of the tabs located on either an inner or an outer peripheral edge of the plate and extending therefrom, the tabs sized to be bent over the first and second insulators to clamp the first and second insulators together to form an annular electric resistance heater assembly comprising the first and second insulators and the plate; and e) means for mounting the annular electrical resistance heater assembly to a structure to support the heater assembly in place.

2. The heater assembly of claim 1, wherein each of the first and second insulators are mica boards.

3. The heater assembly of claim 1, wherein each of the first and second insulators have notches in an outer and inner edge thereof, each notch aligned with each tab of the plate.

4. The heater assembly of claim 1, wherein the means for mounting the plate further comprises a plurality of members, each member extending upwardly from the outer peripheral edge of the plate.

5. The heater assembly of claim 4, wherein each of the first and second insulators have a notch to receive each member.

6. The heater assembly of claim 1, wherein a second heater element is annularly arranged adjacent to said one heater element.

7. The heater assembly of claim 1, wherein the plurality of tabs are arranged in pairs that oppose each other from the inner and outer peripheral edges of the plate.

8. The heater assembly of claim 1, wherein the first and second insulators are made in segments, the segments of each of the first and second insulators forming joints with at least some of the tabs of the plurality of tabs positioned at the joints.

9. The heater assembly of claim 8, wherein the joints of each of the segments of the first and second insulators are 90 degrees apart.

10. The heater assembly of claim 1, wherein the plate includes a terminal support structure extending from an edge thereof.

11. The heater assembly of claim 1, wherein said at least one heater element is a heater ribbon.

12. The heater assembly of claim 4 wherein said each member extends upwardly in the direction of said first and second insulators.

* * * * *